US009104152B2

(12) United States Patent
Kondoh et al.

(10) Patent No.: US 9,104,152 B2
(45) Date of Patent: Aug. 11, 2015

(54) PRESSING MEMBER, FIXING DEVICE, AND IMAGE FORMING APPARATUS

(71) Applicants: Tsuneaki Kondoh, Kanagawa (JP); Tomoaki Sugawara, Kanagawa (JP); Yuko Arizumi, Kanagawa (JP); Junichiro Natori, Kanagawa (JP)

(72) Inventors: Tsuneaki Kondoh, Kanagawa (JP); Tomoaki Sugawara, Kanagawa (JP); Yuko Arizumi, Kanagawa (JP); Junichiro Natori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/156,587

(22) Filed: Jan. 16, 2014

(65) Prior Publication Data

US 2014/0205334 A1 Jul. 24, 2014

(30) Foreign Application Priority Data

Jan. 22, 2013 (JP) ..... 2013-009200

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2085; G03G 15/2082; G03G 2215/2035
USPC ..... 399/329
See application file for complete search history.

(56) References Cited

U.S. PATENT DOCUMENTS

| | | | | |
|---|---|---|---|---|
| 3,578,797 | A | 5/1971 | Hodges et al. | |
| 5,666,624 | A * | 9/1997 | Kanesawa et al. | 399/329 |
| 6,080,255 | A | 6/2000 | Shinkai et al. | |
| 6,493,529 | B1 | 12/2002 | Umemura et al. | |
| 6,895,208 | B2 * | 5/2005 | Nakatogawa et al. | 399/329 |
| 7,133,634 | B2 * | 11/2006 | Komuro et al. | 399/328 |
| 7,321,746 | B2 * | 1/2008 | Sakakibara et al. | 399/333 |
| 7,953,361 | B2 * | 5/2011 | Obata et al. | 399/329 |
| 8,290,418 | B2 * | 10/2012 | Kim et al. | 399/333 |
| 2003/0190540 | A1 | 10/2003 | Shoshi et al. | |
| 2004/0057759 | A1 * | 3/2004 | Ogiso et al. | 399/329 |
| 2004/0069404 | A1 | 4/2004 | Kondoh | |
| 2004/0165917 | A1 | 8/2004 | Sugawara et al. | |
| 2004/0224165 | A1 | 11/2004 | Kondoh et al. | |
| 2005/0095381 | A1 | 5/2005 | Kondoh | |
| 2005/0106483 | A1 | 5/2005 | Shoshi et al. | |
| 2005/0112487 | A1 | 5/2005 | Shoshi et al. | |
| 2005/0207806 | A1 | 9/2005 | Yoshii et al. | |

(Continued)

FOREIGN PATENT DOCUMENTS

| | | |
|---|---|---|
| JP | 63-313182 | 12/1988 |
| JP | 6-067556 | 3/1994 |

(Continued)

OTHER PUBLICATIONS

Machine translation of JP 2002268424 A.*

*Primary Examiner* — David Bolduc
(74) *Attorney, Agent, or Firm* — Cooper & Dunham LLP

(57) ABSTRACT

A pressing member includes a heat resistant material, highly heat conductive needle shaped fillers included in the heat resistant material, and hole portions included in the heat resistant material. The pressing member is provided in a fixing device including a fixing member, a heating member to heat the fixing member, and a pressure roller. The pressing member is arranged to press the fixing member and form a nip portion between the fixing member and the pressure roller through which a recording sheet passes.

9 Claims, 4 Drawing Sheets

(56) References Cited

U.S. PATENT DOCUMENTS

| | | | | |
|---|---|---|---|---|
| 2005/0214669 | A1* | 9/2005 | Hayashi et al. | 430/109.4 |
| 2005/0266331 | A1 | 12/2005 | Arizumi et al. | |
| 2006/0014021 | A1 | 1/2006 | Sugawara et al. | |
| 2006/0056887 | A1* | 3/2006 | Maeyama et al. | 399/328 |
| 2006/0182474 | A1* | 8/2006 | Naito et al. | 399/329 |
| 2006/0188300 | A1* | 8/2006 | Matsunaka et al. | 399/333 |
| 2006/0198666 | A1 | 9/2006 | Kondoh et al. | |
| 2006/0216077 | A1* | 9/2006 | Komuro | 399/328 |
| 2007/0059063 | A1* | 3/2007 | Nakayama et al. | 399/329 |
| 2007/0071522 | A1* | 3/2007 | Kaji et al. | 399/329 |
| 2007/0140758 | A1 | 6/2007 | Aze et al. | |
| 2007/0248380 | A1* | 10/2007 | Iwamoto et al. | 399/130 |
| 2008/0069612 | A1 | 3/2008 | Nakamura et al. | |
| 2008/0138123 | A1 | 6/2008 | Kondoh et al. | |
| 2008/0213002 | A1 | 9/2008 | Katano et al. | |
| 2009/0003903 | A1 | 1/2009 | Katano et al. | |
| 2009/0022527 | A1 | 1/2009 | Nakamura et al. | |
| 2009/0028617 | A1* | 1/2009 | Katakabe et al. | 399/333 |
| 2009/0067868 | A1 | 3/2009 | Arizumi et al. | |
| 2009/0263584 | A1 | 10/2009 | Katano et al. | |
| 2009/0324309 | A1 | 12/2009 | Nakamura et al. | |
| 2010/0119269 | A1 | 5/2010 | Kondoh et al. | |
| 2010/0129123 | A1 | 5/2010 | Natori et al. | |
| 2010/0310290 | A1* | 12/2010 | Sugawara | 399/333 |
| 2011/0002718 | A1 | 1/2011 | Katano et al. | |
| 2011/0013957 | A1 | 1/2011 | Katano et al. | |
| 2011/0058866 | A1 | 3/2011 | Ishii et al. | |
| 2011/0070006 | A1* | 3/2011 | Sone et al. | 399/333 |
| 2011/0091252 | A1* | 4/2011 | Sekihara et al. | 399/333 |
| 2011/0217092 | A1* | 9/2011 | Sekihara et al. | 399/328 |
| 2011/0217098 | A1 | 9/2011 | Tomono et al. | |
| 2011/0222933 | A1* | 9/2011 | Maruyama et al. | 399/329 |
| 2011/0229231 | A1 | 9/2011 | Kaneko et al. | |
| 2011/0268480 | A1 | 11/2011 | Katano et al. | |
| 2012/0014726 | A1* | 1/2012 | Sekihara et al. | 399/333 |
| 2012/0121303 | A1* | 5/2012 | Takagi et al. | 399/329 |
| 2012/0135342 | A1 | 5/2012 | Katano et al. | |
| 2012/0155932 | A1* | 6/2012 | Nakamura et al. | 399/329 |
| 2012/0269560 | A1* | 10/2012 | Sakakibara | 399/335 |
| 2012/0294659 | A1* | 11/2012 | Lee et al. | 399/329 |
| 2012/0322967 | A1 | 12/2012 | Kondoh et al. | |
| 2013/0065045 | A1* | 3/2013 | Gervasi et al. | 428/327 |
| 2013/0089350 | A1* | 4/2013 | Mukai | 399/69 |
| 2013/0251425 | A1* | 9/2013 | Son et al. | 399/331 |
| 2013/0259544 | A1* | 10/2013 | Ryu et al. | 399/328 |
| 2013/0272762 | A1* | 10/2013 | Uekawa et al. | 399/329 |

FOREIGN PATENT DOCUMENTS

| | | | | |
|---|---|---|---|---|
| JP | 8-262903 | | 10/1996 | |
| JP | 2002268424 | A * | 9/2002 | G03G 15/20 |
| JP | 2008-197585 | | 8/2008 | |
| JP | 2009092826 | A * | 4/2009 | |
| JP | 2009109998 | A * | 5/2009 | |
| JP | 2010152303 | A * | 7/2010 | |
| JP | 2011-059247 | | 3/2011 | |
| JP | 2011112895 | A * | 6/2011 | |
| JP | 2011227512 | A * | 11/2011 | |
| JP | 2011237681 | A * | 11/2011 | |

* cited by examiner

FIXING SLEEVE TYPE

FIXING SLEEVE TYPE

PRESSURE SLEEVE TYPE

PRESSING MEMBER, FIXING DEVICE, AND IMAGE FORMING APPARATUS

CROSS-REFERENCE TO RELATED APPLICATIONS

This patent application is based on and claims priority pursuant to 35 U.S.C. §119 from Japanese Patent Application No. 2013-009200, filed on Jan. 22, 2013 in the Japan Patent Office, which is hereby incorporated by reference herein in its entirety.

BACKGROUND

1. Technical Field

Exemplary embodiments of the present disclosure generally relates to a pressing member, a fixing device including the pressing member, and an electrophotographic image forming apparatus, such as a copier, a printer, or a facsimile machine, including the fixing device.

2. Related Art

Conventionally, image forming apparatuses employing the electrophotographic method such as a copier, a printer, and a facsimile machine typically include a rotary photoreceptor drum, a charger that charges the photoreceptor drum, a laser scanning unit that emits a laser beam and exposes the photoreceptor drum after being charged by the charger to form an electrostatic latent image, a development device that develops the electrostatic latent image on the photoreceptor drum with toner to form a toner image on the photoreceptor drum, a transfer device to transfer the toner image from the photoreceptor drum onto a recording sheet, and a fixing device that heats and fixes the toner image on the recording sheet when the recording sheet with the toner image passes through the fixing device.

Generally, the employed fixing method to fix the toner image onto the recording sheet includes a fixing member (e.g., fixing roller, fixing belt) and a pressure roller. The recording sheet with the toner image passes in between the fixing member and the pressure roller. The pressure roller contacts and presses the recording sheet to the fixing member and the fixing member heats the toner of the toner image adhering to the recording sheet. The toner of the toner image on the recording sheet is softened and pressed to the recording sheet. Accordingly, the toner image is fixed on the recording sheet. In the above-described fixing method, the melted and fixed toner image on the recording sheet contacts the fixing member. Thus, a release layer formed of a material having good releasing properties (e.g., fluorine-based resin) with a layer thickness in a range from approximately 5 μm to approximately 30 μm is formed on the surface of the fixing member. A roller method is conventionally employed for the fixing member though due to a need to form an elastic layer having sufficient elasticity to obtain appropriate heating time with respect to color images and following capability, a belt method is recently employed for the fixing member (for example, refer to U.S. Pat. No. 3,578,797).

Further, a method (fixing sleeve type) of providing a pressing member and a heating body fixed to a metal or a resin holder inside a heat resistant sleeve, and fixing the toner image on the recording sheet by heating the recording sheet via the heat resistant sleeve is devised. FIG. 3A is a schematic view of a configuration of a fixing device including the heat resistant sleeve 303, the elastic layer 302, the release layer 301, a halogen heater constituting the heating body 304, a pressing member 306 fixed to a holder 305, and a pressure roller 309 that forms a nip with the release layer 301. The pressure roller 309 includes a sponge elastic layer 307, and a second release layer 308 having carbon. The configuration of 3A separates a heat source (i.e., heating body 304) and the pressing member 306. An example of the fixing device of 3A is disclosed in JP-2011-59247-A. FIG. 3B is a schematic view of a configuration of a fixing device including the heat resistant sleeve 303, the elastic layer 302, the release layer 301, a plate shaped heating body 310 and a pressing member 306 fixed to a holder 305, and the pressure roller 309 that forms a nip with the release layer 301. The plate shaped heating body 310 and the pressing member 306 fixed to the holder 305 is provided within the heat resistant sleeve 303. The configuration of 3B integrates the heating body 304 and the pressing member 306. Accordingly, the configuration of the fixing device of 3B has a short heat-up time to reach a predetermined fixing temperature. An example of the fixing device of 3B is disclosed in JP-S63-313182-A. It is to be noted that the heating body 304 and the pressing member 306 do not have to be inside the same heat resistant sleeve 303. The configuration of 3C is a schematic view of a configuration of a fixing device including the pressing member 306 provided inside heat resistant sleeve 303, and the heating body 304 provided inside the opposite pressure roller 309. An example of the fixing device of 3C is disclosed in JP-3298354-B1 (JP-H8-262903-A). Accordingly, the configuration of the fixing device of 3C has good recording sheet releasability.

However, recording sheets of various sizes are generally employed in the above-described fixing devices. For example, when a narrow width size recording sheet of 182 mm width B5 Size or an envelope of 105 mm width is passed through a fixing device that is capable of handling a maximum size recording sheet of 216 mm width Letter Size, heat at portions of a fixing member at which the narrow width size recording sheet does not pass through is not absorbed by the narrow width size recording sheet. Thus, uneven heat distribution is significantly generated in an axial direction of the fixing member and abnormal temperature rise at portions corresponding to end portions of the narrow width size recording sheet occurs. Accordingly, problems of degradation of the opposite pressure roller, wrinkling of the narrow width size recording sheet, unevenness of image gloss, and high temperature offset of toner are generated due to unevenness of heat of a surface of the fixing member.

To resolve the above-described problems, a method of suppressing abnormal temperature rise at portions corresponding to end portions of a recording sheet by locally reversing a state of insulation of the heating body and surrounding members is publicly known. An example of the publicly known method is disclosed in JP-H6-67556-A. However, the publicly known method disclosed in JP-H6-67556-A requires a method to detect size of the recording sheet and a driving system and is high-cost. In addition, the method disclosed in JP-H6-67556-A has a complex mechanism and uncertainty regarding mechanical reliability remains. Further, the method disclosed in JP-H6-67556-A can be only applied to the configuration shown in FIG. 3B. The method disclosed in JP-H6-67556-A cannot be applied to the configurations shown in FIG. 3A and FIG. 3C constituting a pressing pad method.

SUMMARY

In view of the foregoing, in an aspect of this disclosure, there is provided a novel pressing member including a heat resistant material, highly heat conductive needle shaped fillers included in the heat resistant material, and hole portions included in the heat resistant material. The pressing member is provided in a fixing device including a fixing member, a heating member to heat the fixing member, and a pressure roller. The pressing member is arranged to press the fixing member and form a nip portion between the fixing member and the pressure roller through which a recording sheet passes.

The aforementioned and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
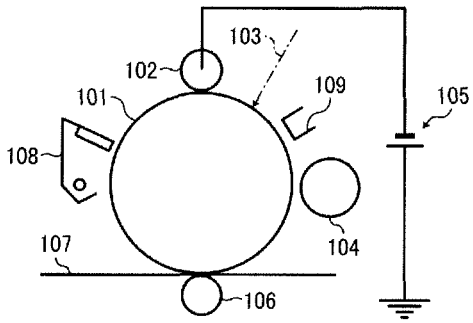
FIG. 1A is a schematic view of a photoreceptor and an image forming system of a copier.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of this disclosure, there is provided a novel pressing member employed in a fixing device that resolves the above-describe problems and obtains mitigation of abnormal temperature rise at end portions of the pressing member due to passing through a small size recording sheet continuously, reduction of uneven gloss leading to high quality image, reduction in stopping for a short time period due to abnormal temperature rise at end portions of the pressing member, prevention of wrinkling of the small size recording sheet, and enhancement of durability and reliability of the pressure roller.

Referring now to the drawings, exemplary embodiments of a pressing member of the present invention employed in an image forming apparatus are described below.

Figure 1B:
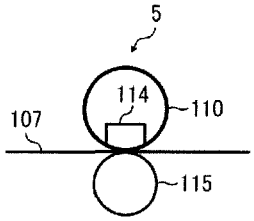
FIG. 1B is a schematic view of a configuration of a fixing device.
Figure 1C:
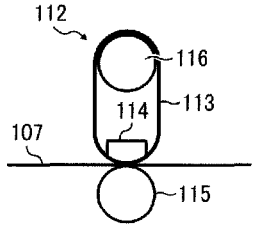
FIG. 1C is a schematic view of a configuration of another fixing device.

FIG. 1A is a schematic view of a photoreceptor and an image forming system of a copier. FIG. 1B and FIG. 1C is a schematic view of a configuration of a fixing device. An image forming process of an electrophotographic image forming apparatus includes uniformly charging a photosensitive layer of a rotatable photoreceptor drum 101 with a charging roller 102, exposing the photosensitive layer with a laser beam 103 from a laser scanning unit not shown in FIG. 1A to form an electrostatic latent image on the photosensitive layer of the photoreceptor drum 101, developing the electrostatic latent image on the photosensitive layer of the photoreceptor drum 101 with a toner to form a toner image on the photosensitive layer, transferring the toner image from the photosensitive layer onto a recording sheet 107, and passing the recording sheet 107 with the toner image through a fixing device that applies heat and pressure to the toner image to fix the toner image onto the recording sheet 107.

A developing roller 104, a power pack (power source) 105, a transfer roller 106, a cleaning device 108, and a surface potentiometer 109 are also shown in FIG. 1A.

The fixing device is configured of a fixing member, a heating member to heat the fixing member, a pressure roller, and a pressing member arranged to press the fixing member and form a nip portion between the fixing member and the pressure roller. A recording sheet passes through the nip portion. The pressing member is an embodiment of the present invention.

In the fixing device 5 shown in FIG. 1B, a fixing sleeve 110 constituting the fixing member is configured of a base and an elastic layer formed on the base. In the fixing sleeve 110, a heater such as a halogen lamp constituting the heating member is arranged along the center of rotation of and in a hollow portion of the fixing sleeve 110. The fixing sleeve 110 is heated from the inside by heat radiated by the heater. A pressure roller 115 is provided parallel to the fixing sleeve 110. The pressure roller 115 presses and contacts the fixing sleeve 110. By passing through a recording sheet between the pressure roller 115 and the fixing sleeve 110, toner of the toner image adhering on the recording sheet is softened by the heat of the fixing sleeve 110, and pressure is applied by sandwiching the recording sheet between the pressure roller 115 and the fixing sleeve 110. Accordingly, the toner image is fixed onto the recording sheet. In the fixing sleeve 110 constituting the fixing member, a pressing member 114 is arranged to press the fixing sleeve 110 and form the nip portion between the fixing sleeve 110 and the pressure roller 115. The recording sheet passes through the nip portion.

The fixing device according to an embodiment of the present invention may be a belt type fixing device 112 as shown in FIG. 1C.

A fixing belt 113, a pressing member 114, a pressure roller 115, and a heating roller 116 are also shown in FIG. 1C. Color toners of four colors, cyan (C), magenta (M), yellow (Y) and black (K) are employed in a full color copier or a laser printer. There is a need to mix the color toners at a melting state when fixing a color image formed of the color toners. Thus, there is a need to make the color toners have a low melting point and, by encompassing various color toners, uniformly mix various color toners at a melting state at the surface of the fixing belt 113. (Hereinafter, the fixing roller and the fixing belt is collectively referred to as the fixing member) The fixing belt constituting a heating member is supported by and stretched around the pressing member 114 and the heating roller 116.

Figure 2:
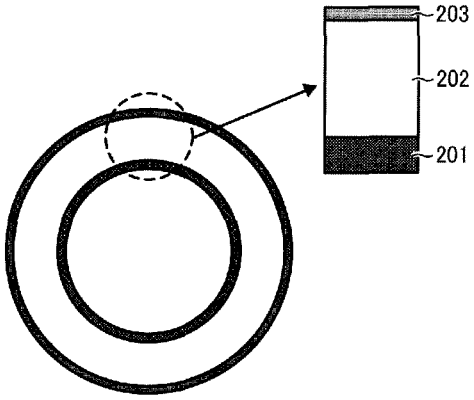
FIG. 2 is a schematic view of a configuration of a fixing member.
Figure 3A:
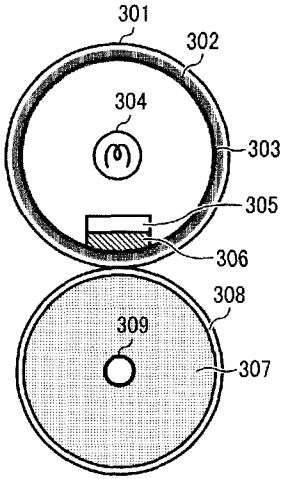
FIG. 3A RELATED ART
FIG. 3A is schematic view of a configuration of a conventional fixing device employing a pressing member.
Figure 3B:
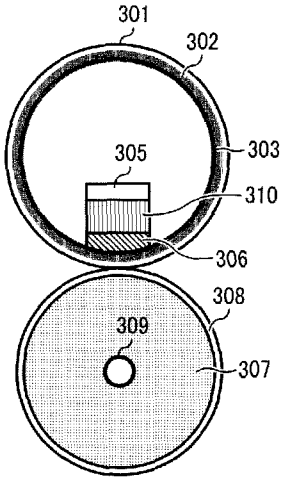
FIG. 3B RELATED ART
FIG. 3B is schematic view of a configuration of a second conventional fixing device employing a pressing member.
Figure 3C:
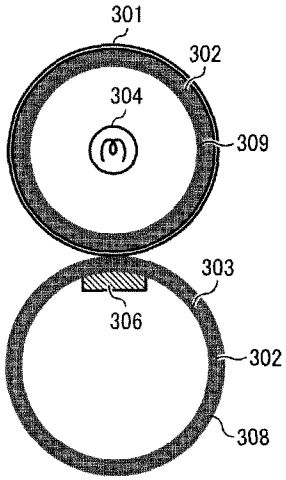
FIG. 3C RELATED ART
FIG. 3C is schematic view of a configuration of a third conventional fixing device employing a pressing member.

FIG. 2 is a schematic view of a configuration of the fixing member. The fixing member is configured of a base 201, an elastic layer 202, and a release layer 203. The base 201 is formed of a heat resistant material. Specific examples of the heat resistant material include, but is not limited to, resin materials such as polyimide, polyamide imide, polyetheretherketone (PEEK) resin, polyethersulfone (PES) resin, polyphenylene sulfide (PPS) resin, and fluorine resin. Resin materials including magnetic conductive particles may be also employed. In a case of employing resin materials including magnetic conductive particles, the amount of added magnetic conductive particles is in a range from approximately 20% by weight to approximately 90% by weight with respect to a resin material. More specifically, the magnetic conductive particles are dispersed within resin materials in a varnish state employing a dispersion device such as a roll mill, a sand mill, and a centrifugal mixer. The prepared resin materials with dispersed magnetic conductive particles is adjusted to an appropriate viscosity with a solvent and molded into a desired layer thickness with a mold. Alternatively, the base 201 may be formed of a metal (a metal sleeve distinguished from a roller). More specifically, the metal may be an alloy of nickel, iron, and chrome. The metal itself may generate heat. The layer thickness of the base 201 is formed in a range from approximately 30 μm to approximately 500 μm from the viewpoint of heat capacity and strength.

In a case of employing the metal, it is preferable that the layer thickness is 100 m or less when considering flexure of a fixing belt form in a belt type fixing device. In a case of employing the metal, a desired curie point may be obtained by adjusting amount of addition and processing conditions of each material. By forming a heating layer with a magnetic conductive material having a curie point around a fixing temperature of the fixing belt, the heating layer may be heated without excessive temperature rise due to electromagnetic induction. The heating layer may also be an elastic body. Specific examples of the elastic body include, but are not limited to, natural rubber, styrene butadiene rubber (SBR), butyl rubber, chloroprene rubber, nitrile rubber, acrylic rubber, urethane rubber, silicone rubber, fluorosilicone rubber, fluororubber, and liquid state fluorine elastomer. From the standpoint of heat resistance, silicone rubber, fluorosilicone rubber, fluororubber, fluorocarbon siloxane rubber, and liquid state fluorine elastomer are preferable.

The elastic layer 202 formed on the base 201 is an elastic body having heat resistance. Preferably, the elastic layer 202 is formed of a heat resistant rubber. Specific examples of the heat resistant rubber include, but are not limited to, natural rubber, styrene butadiene rubber (SBR), butyl rubber, chloroprene rubber, nitrile rubber, acrylic rubber, urethane rubber, silicone rubber, fluorosilicone rubber, fluororubber, and liquid state fluorine elastomer. From the standpoint of heat resistance, silicone rubber, fluorosilicone rubber, fluororubber, fluorocarbon siloxane rubber, and liquid state fluorine elastomer are preferable. From the viewpoint of heat resistance and wettability of a release agent, silicone rubber and fluorosilicone rubber are preferable.

There is no restriction regarding forming methods of the elastic layer 202 and may be selected according to objective. For example, a blade coating method, a roll coating method, and a die coating method may be selected.

There is no restriction regarding thickness of the elastic layer 202 and may be selected according to objective. Preferably, the thickness of the elastic layer 202 is in a range from approximately 100 μm to approximately 250 μm.

The releasing layer 203 formed on the base 201 or the elastic layer 202 may be formed of the following materials. For example, fluorine-based polymers such as polytetrafluoroethylene (PTFE), tetrafluorothylene/perfluoroalkyl-vinylether copolymer (PFA), and tetrafluoroethylene/hexafluoropropylene copolymer (FEP); a heat resistant resin/rubber including dispersed above-described fluorine-based polymers or a mixture of two or more of the above-described fluorine-based polymers; or a fluorine-based elastomer having fluorinated polyether in a silicone crosslinking reaction group. Among the above-described examples, a material including fluorine-based polymers is preferable from the viewpoint of balancing strength and smoothness. In the releasing layer 203, a conductive material such as hollow fillers may be added as a low specific heat and low heat conduction rate material. There is no restriction regarding forming methods of the releasing layer 203 and may be selected according to objective. Specific examples of forming methods include, but are not limited to, making a tubular shaped releasing layer 203 and covering over the elastic layer 202, and employing a wet-type spray coating method to coat release layer 203 material particles on the base 201 or the elastic layer 202 and firing.

The thickness of the releasing layer 203 is preferably in a range from approximately 0.01 μm to approximately 5 μm, and more preferably in a range from approximately 0.01 μm to approximately 3 μm. When the thickness of the releasing layer 203 is less than approximately 0.01 μm, film formation may not be possible due to roughness of the elastic layer 202. When the thickness of the releasing layer 203 is more than approximately 5 μm, a defective image with difference in level may be formed such as difference in a gloss level.

Figure 4:
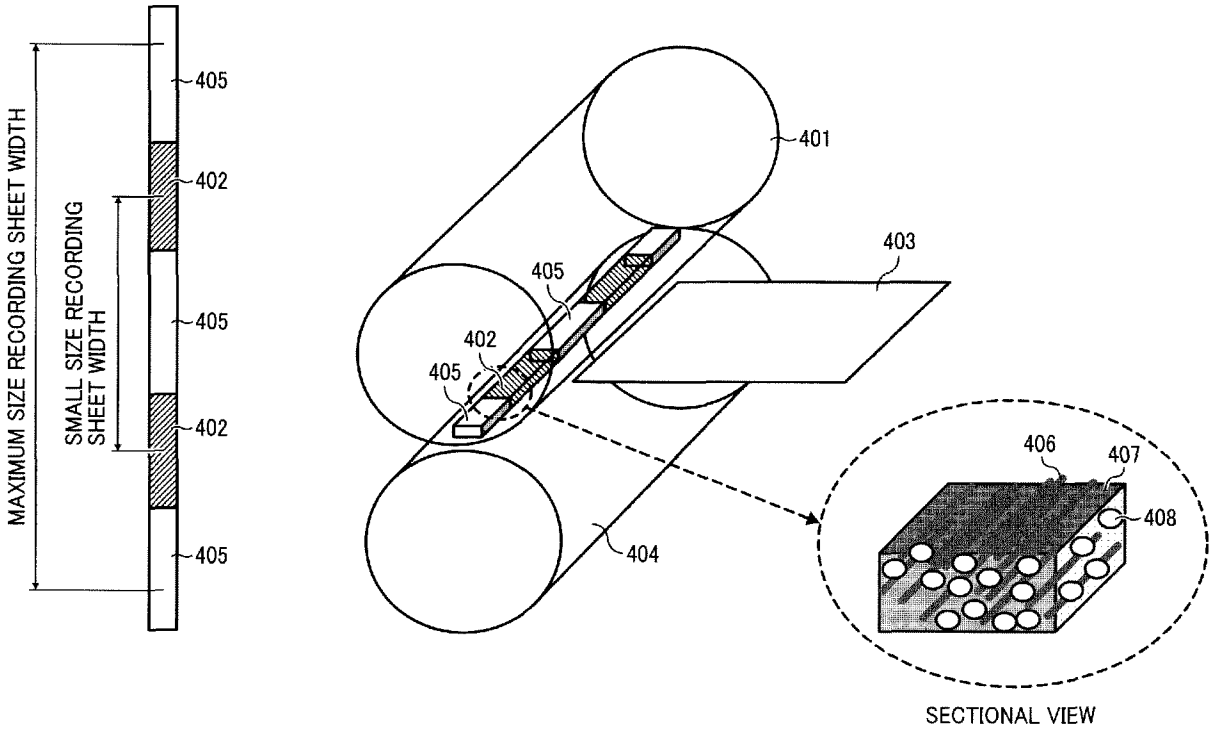
FIG. 4 is a schematic view of an example employing a pressing member according to an embodiment of the present invention.

FIG. 4 is a schematic view of a configuration of the pressing member.

The pressing member according to an embodiment of the present invention is configured of highly heat conductive needle shaped fillers 406 and a heat resistant material 407. The heat resistant material 407 includes hole portions 408. Portions of the pressing member configured of the highly heat conductive needle shaped fillers 406 and the heat resistant material 407 including the hole portions 408 have highly heat conductivity and low heat capacity. Accordingly, the portions of the pressing member configured of highly heat conductive needle shaped fillers 406 and the heat resistant material 407 including the hole portions 408 have good heat diffusivity.

The highly heat conductive needle shaped fillers 406 may be carbon fibers, boron nitride, alumina, silicon nitride, aluminum nitride, and various metal fillers such as silver. The carbon fibers may be, for example, polyacrylonitrile (PAN) carbon fibers made from synthetic fibers of acrylic long fibers, or pitch-based carbon fibers made from coal tar and petroleum pitch. PAN-based carbon fibers are obtained by carbonization of PAN precursors (i.e., polyacrylonitrile fibers) and have characteristics of high strength and high elastic modulus. Pitch-based carbon fibers are obtained by carbonization of pitch precursors (i.e., pitch fibers obtained from coal tar or petroleum distillates as raw materials) and have a wide range of characteristics from low elastic modulus to ultra high elastic modulus and high strength depending upon conditions of manufacturing. Pitch-based carbon fibers having ultra high elastic modulus are employed for high rigidity and have properties of good heat conductivity and good electrical conductivity. From the viewpoint of heat conductivity, it is preferable that pitch-based carbon fibers are employed for the pressing member according to an embodiment of the present invention.

Materials for the heat resistant material 407 are as follows. Specific examples of materials for the heat resistant material 407 include, but are not limited to, fluorine-based polymers such as PTFE, PFA, and FEP; a heat resistant resin/rubber including dispersed above-described fluorine-based polymers or a mixture of two or more of the above-described fluorine-based polymers; or a fluorine-based elastomer having fluorinated polyether in a silicone crosslinking reaction group. Further, a highly heat resistant epoxy resin; resins such as polyphenylene sulfide, polyimide, polyamide, polyetheretherketone, liquid crystal polymer, silicone rubber, and phenol resin; and a mixture of the above-described resins and ceramics, metals, and glass. Among the above-described examples, it is preferable that fluorine-based polymers are employed for the heat resistant material 407 from the viewpoint of balancing strength, lubrication property, and heat resistant property. In addition, the fluorine-based polymers employed for the heat resistant material 407 according to an embodiment of the present invention preferably have comparatively low melting point for good melt film forming property when fired. Preferably, the comparatively low melting point is in a range from approximately 250° C. to approximately 300° C.

More specifically, materials for the heat resistant material 407 may be fine particles of low molecular weight PTFE, FEP, and PEA. Specific examples of low molecular weight PTFE particles include, but are not limited to, Lubron L-5 and L-2 (from Daikin Industries, Ltd.); and MP1100, 1200, 1300, TLP-10F-1 (from Du pont-Mitsui Fluorochemicals Co., Ltd.). A specific example of FEP particles includes, but is not limited to, 532-8000 (from Du pont). Specific examples of PFA particles include, but are not limited to, MP-10 and MP102 (from Du pont-Mitsui Fluorochemicals Co., Ltd.). MP103 and MP300 (from Du pont-Mitsui Fluorochemicals Co., Ltd.), and AC-5600 and AC5539 (from Daikin Industries, Ltd.) particularly have low fluidity or a small melt flow rate (MFR). Among the above-described fine particles, it is preferable that low molecular weight PTFE is employed from the viewpoint of workability and cost.

A foaming agent to form the hole portions 408 include, but is not limited to, azobisisobutyronitrile (AIBN). Specific examples of foaming particles include, but are not limited to, F-30, F-30VS, F-46, F-50, and F-55 (from Matsumoto Yushi-Seiyaku Co., Ltd.). A specific example of a resin balloon includes, but is not limited to, F-80ED (from Matsumoto Yushi-Seiyaku Co., Ltd.). Specific examples of an inorganic balloon include, but are not limited to, fillite (from Japan Fillite Co., Ltd.) and silica balloon (from Taiheiyo Coal Services & Transportation Co., Ltd.).

Portions of the pressing member configured of highly heat conductive needle shaped fillers 406 and the heat resistant material 407 including the hole portions 408 are formed by mixing and kneading the above-described fillers, materials, foaming agent, foaming particles, resin balloon, and inorganic balloon. In a case of employing a thermoplastic material, sufficient heat is applied to the mixed and kneaded above-described fillers, materials, foaming agent, foaming particles, resin balloon, and inorganic balloon to extrude and mold the above-described portions of the pressing member in extrusion molding. In a case of employing a thermosetting resin, the mixed and kneaded above-described fillers, materials, foaming agent, foaming particles, resin balloon, and inorganic balloon are poured into a mold and hardened. In a case of forming a thin film layer, dipping may be employed to form the mixed and kneaded above-described fillers, materials, foaming agent, foaming particles, resin balloon, and inorganic balloon. In the above-described three cases, the highly heat conductive needle shaped fillers 406 are arranged in the direction of extrusion, direction of pouring, and direction of pulling up. It is preferable that the highly heat conductive needle shaped fillers 406 are arranged to match an axial direction of a fixing sleeve 401 constituting the fixing member.

By arranging the highly heat conductive needle shaped fillers 406 to match the axial direction of the fixing sleeve 401, heat diffusion in a circumferential direction of the fixing sleeve 401 is prevented, efficient mitigation of abnormal temperature rise at end portions of the pressing member is obtained, and uneven gloss due to uneven heat is reduced.

The direction of arrangement of the highly heat conductive needle shaped fillers 406 may be confirmed with a laser microscope.

For example, the direction of arrangement of the carbon fibers are observed with a microscope VHX-1000 and zoom lens VH-Z100R (from Keyence Corporation), and measured in a determined range of 800 μm×600 μm with a lens of an object magnification of 300 times. With respect to carbon fibers of a length of 100 μm or more within the determined range, a deflection angle to the axial direction is measured. When a ratio of the carbon fibers having a deflection angle within 30° to the axial direction at both ends of the carbon fibers in the determined range is 50% or more with respect to all of the carbon fibers, the carbon fibers are determined as being "arranged in the axial direction of the fixing sleeve 401."

Figure 5:
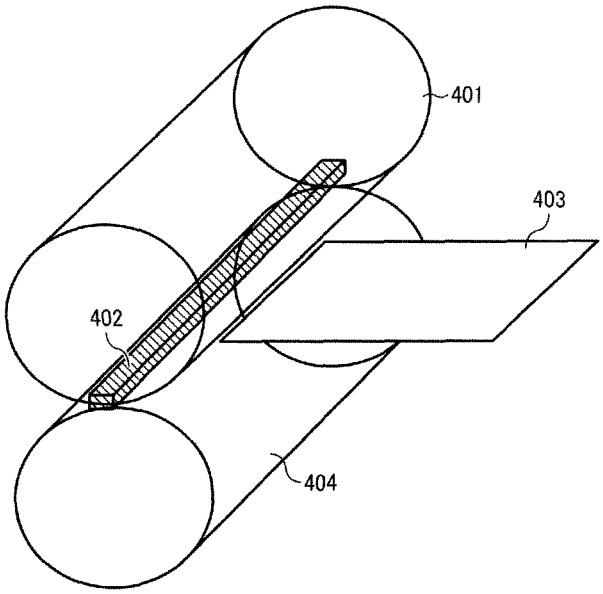
FIG. 5 is a schematic view of another example employing a pressing member according to an embodiment of the present invention.

In addition, it is preferable that the portions of the pressing member configured of highly heat conductive needle shaped fillers 406 and the heat resistant material 407 including the hole portions 408 are arranged at regions of the pressing member corresponding to end portions of a small size recording sheet. In a case of a need to correspond to various small size recording sheets, a uniform configuration of the portions of the pressing member configured of highly heat conductive needle shaped fillers 406 and the heat resistant material 407 including the hole portions 408 may be formed in the axial direction of the fixing sleeve 401 as shown in FIG. 5. Alternatively, a configuration of partially welding the portions (hereinafter referred to as first portions 402) of the pressing member configured of highly heat conductive needle shaped fillers 406 and the heat resistant material 407 including the hole portions 408, and portions (hereinafter referred to as second portions 405) of the pressing member configured only of the heat resistant material 407 without the highly heat conductive needle shaped fillers 406 and the hole portions 408 may be formed as shown in FIG. 4. The first portions 402 are only arranged at regions of the pressing member corresponding to end portions of the small size recording sheet. From the viewpoint of cost and mitigation effect of abnormal temperature rise at end portions of the pressing member, the configuration of FIG. 4 is preferable.

When forming the configuration of partially welding the first portions 402 and the second portions 405, it is preferable that the first portions 402 are formed in regions of the pressing member that includes end portions of the small size recording sheet. More specifically, the first portions 402 are formed in a range from approximately ±5 mm to approximately ±60 mm of the pressing member with respect to end portions of the small size recording sheet. More preferably, the first portions 402 are formed in a range from approximately ±10 mm to approximately ±30 mm (approximately 20 mm to approximately 60 mm width) of the pressing member with respect to end portions of the small size recording sheet.

It is preferable that heat conductivity in the axial direction of the first portions 402 is approximately 0.5 W/mK or more. In a case, heat conductivity in the axial direction of first portions 402 is approximately 0.5 W/mK or more, efficient mitigation of abnormal temperature rise at end portions of the pressing member is obtained. In a case heat conductivity in the axial direction of first portions 402 is less than approximately 0.5 W/mK, sufficient heat conductivity may not be obtained.

In addition, it is preferable that expansion ratio of foaming of the first portions 402 is approximately 1.5 or more to approximately 3.0 or less. In a case, expansion ratio of foaming is less than 1.5, heat capacity is large and heat diffusion rate declines. As a result, sufficient mitigation of abnormal temperature rise at end portions of the pressing member may not be obtained. In a case, expansion ratio of foaming is more than 3.0, sufficient durability is not obtained. As a result, end portions of the first portions 402 may break off and lead to insufficient pressing area to form the nip. A balance of efficient mitigation of abnormal temperature rise at end portions of the pressing member and durability is obtained with approximately 1.5 or more to approximately 3.0 or less expansion ratio of foaming of the first portions 402.

The expansion ratio of foaming of the first portions 402 (hereinafter referred to as heat resistant elastic layer) may be determined as follows. Calculating density of the heat resistant elastic layer excluding the hole portions 408 (a state excluding the foaming particles), calculating density of the heat resistant elastic layer including the hole portions 408, and determining the expansion ratio of foaming from the ratio of the two calculated densities. For example, when density of the heat resistant elastic layer excluding the hole portions 408 (a state excluding the foaming particles) is approximately 1.0 g/cm$^3$, and density of the heat resistant elastic layer including the hole portions 408 is approximately 0.5 g/cm$^3$, the expansion ratio of foaming is 1.0/0.5=2.

Density of the heat resistant elastic layer excluding the hole portions 408 (a state excluding the foaming particles) may be calculated from the physical properties of materials constituting the heat resistant elastic layer. Density of the heat resistant elastic layer including the hole portions 408 may be calculated with methods such as Archimedes method.

The pressure roller 404 is formed of a base, an elastic body, and a release layer. Materials that form the base, the elastic body, and the release layer are the same as the above-described fixing member. Diameter and thickness of the base, the elastic body, and the release layer are appropriately optimized. For example, the base may be a metal roller, the elastic body may be formed of a heat resistant solid rubber or a spongy rubber laminated on the outer circumference of the base, and the release layer may be formed of a fluorine-based polymer laminated on the outer circumference of the elastic body. Carbon may be added to enhance abrasion resistance of the release layer.

The fixing device according to an embodiment of the present invention employed in a process of heating a toner image on a recording sheet and fixing the toner image onto the recording sheet includes the following. The fixing device includes the fixing member, the heating member to heat the fixing member, the pressure roller, and the pressing member arranged to press the fixing member and form a nip portion between the fixing member and the pressure roller. A recording sheet passes through the nip portion. By employing the pressing member according to an embodiment of the present invention, high quality image, reduction in stopping for a short time period due to abnormal temperature rise at end portions of the pressing member, and enhancement of durability and reliability are obtained.

Accordingly, an image forming apparatus employing the fixing device according to an embodiment of the present invention obtains both high quality image and high reliability, and stable fixing over a long time period.

EXAMPLES

Further understanding can be obtained by reference to specific examples, which are provided hereinafter. However, it is to be understood that the embodiments of the present invention are not limited to the following examples. Particularly, parts are defined as parts by weight unless explicitly described otherwise.

Examples 1 to 6

Highly heat conductive pressing members constituting portions of the pressing member of the fixing device are arranged at portions of the fixing device that abuts a width of a recording sheet to be printed (±20 cm width from end portions of an A4 size recording sheet). The highly heat conductive pressing members are formed of low molecular weight PTFE (KTL-8F from Kitamura Limited) constituting the heat resistant resin, carbon fibers (XN-100-05M from Nippon Graphite Fiber Co., Ltd.) constituting the highly heat conductive needle shaped fillers, and hollow fillers (PAN-based F-80ED from Matsumoto Yushi-Seiyaku Co., Ltd.) constituting a foaming body. The above-described heat resistant resin, carbon fibers, and hollow fillers are blended at a blending ratio (parts by weight with respect to low molecular weight PTFE) shown in Table 1. Method of molding is extrusion molding. Die temperature is controlled to 280±10° C. and a sheet of the highly heat conductive pressing members having 2 mm thickness is extruded. The sheet of the highly heat conductive pressing members having 2 mm thickness is cut into portions with 40 mm length and 10 mm width. The portions of the highly heat conductive pressing members are heated and welded to portions of the pressing member formed of only the heat resistant resin (i.e., low molecular weight PTFE) extruded separately. The portions of the highly heat conductive pressing members are welded to the portions of the pressing member formed of only the heat resistant resin so that the portions of the highly heat conductive pressing members are arranged at portions of the fixing device that abuts the width of the recording sheet to be printed (±20 cm width from end portions of an A4 size recording sheet). It is to be noted that when employing the above-described extrusion method, the carbon fibers constituting the highly heat conductive needle shaped fillers are arranged in the direction of extrusion. Thus, pressing members of Examples 1 to 6 are prepared.

Each of the pressing members of Examples 1 to 6 is mounted in a fixing device imagio MP C2201 SP copier (from Ricoh Company, Ltd.). The fixing device includes the fixing member, the heating member to heat the fixing member, the pressure roller, and the pressing member arranged to press the fixing member and form a nip portion between the fixing member and the pressure roller. A recording sheet passes through the nip portion.

Evaluation of durability of the pressing member and evaluation of gloss unevenness at end portions of an A4 size recording sheet are conducted. 500 sheets of the A4 size recording sheet in a vertical arrangement are passed through at a setting of both side printing of toner solid images, and an A3 size recording sheet is passed through at a setting of printing a solid black color immediately after the 500 sheets. The recording sheet employed as a testing sheet is Multipaper Super White (from Askul Corporation). The evaluations are determined according to standards shown in Table 2. Heat conductivity of the highly heat conductive pressing members in the direction of extrusion (direction of arrangement of the highly heat conductive needle shaped fillers) is measured with a Quick Thermal Conductivity Meter QTM-500 (from Kyoto Electronics Manufacturing Co., Ltd.). Refer to FIG. 4 for a schematic view.

Evaluation results are shown in Table 1.

Measurement of heat conductivity is conducted under the following conditions.

Employed device:

Quick Thermal Conductivity Meter QTM-500 ver 1.03 (from Kyoto Electronics

Manufacturing Co., Ltd.)

Sensor probe:

PD-11 (from Kyoto Electronics Manufacturing Co., Ltd.)

Reference plate:

R2-2, Silicone rubber, $\lambda$=0.235 W/mK (at 32° C.)

R1-2, Quartz glass, $\lambda$=1.417 W/mK (at 28° C.)

R7-2, Zirconia, $\lambda$=3.35 W/mK (at 30° C.)

Measurement method: thin film sample measurement mode

Measurement time: 60 seconds

Measurement temperature: Room temperature

TABLE 1

| | Material | Model | Ex. 1 | Ex. 2 | Ex. 3 | Ex. 4 | Ex. 5 | Ex. 6 |
|---|---|---|---|---|---|---|---|---|
| Blending ratio | Low molecular weight PTFE | KTL-8F Addition amount (Parts) | 100 | 100 | 100 | 100 | 100 | 100 |
| | Carbon fibers | XN-100-05M Addition amount (Parts) | 40 | 40 | 40 | 40 | 40 | 40 |
| | PAN-based foaming body | F-80ED Expansion ratio of foaming | 1.5 | 2 | 3 | 1.3 | 3.2 | 4 |
| Evaluation | Heat conductivity | W/mK | 0.55 | 0.66 | 0.73 | 0.49 | 0.8 | 0.89 |
| | Pass through evaluation (1) | Durability | 3 | 3 | 3 | 3 | 2 | 2 |
| | Pass through evaluation (2) | Gloss unevenness | 3 | 3 | 3 | 2 | 3 | 3 |

TABLE 2

| Evaluation Standards | | | |
|---|---|---|---|
| Item | Content | Passing level rank | Rank determining standards |
| Gloss unevenness | Rank evaluation of gloss unevenness of images due to temperature rise at end portions of the pressing member in accordance with passing through a small size recording sheet continuously | Rank 2 or above | Rank 3: No gloss unevenness<br>Rank 2: Gloss unevenness is seen but image evaluation is at an OK level<br>Rank 1: Gloss unevenness is seen at a No Good (NG) level |
| Durability | Evaluation of breaking and loss of portions of the pressing member in the test of passing through a small size recording sheet continuously | Rank 2 or above | Rank 3: No breaking and loss<br>Rank 2: Breaking and loss is seen but is at an OK level<br>Rank 1: Breaking and loss is seen at a No Good (NG) level |

Examples 7 to 12

The foaming body F-80ED (from Matsumoto Yushi-Seiyaku Co., Ltd.) of the highly heat conductive pressing members in Example 1 is replaced with foaming particles F-30 (from Matsumoto Yushi-Seiyaku Co., Ltd.) and Examples 7 to 12 are formed according to a blending ratio shown in Table 3. Thus pressing members of Examples 7 to 12 are prepared. Evaluation of Example 1 is repeated for Examples 7 to 12. Evaluation results are shown in Table 3.

Examples 13 to 17

The addition amount of carbon fibers of the highly heat conductive pressing members in Example 2 are replaced with the addition amount of carbon fibers shown in Table 4 and Examples 13 to 17 are formed according to a blending ratio shown in Table 4. Thus, pressing members of Examples 13 to 17 are prepared. Evaluation of Example 2 is repeated for Examples 13 to 17. Evaluation results including Example 2 are shown in Table 4.

TABLE 3

| | Material | Model | Ex. 7 | Ex. 8 | Ex. 9 | Ex. 10 | Ex. 11 | Ex. 12 |
|---|---|---|---|---|---|---|---|---|
| Blending ratio | Low molecular weight PTFE | KTL-8F Addition amount (Parts) | 100 | 100 | 100 | 100 | 100 | 100 |
| | Carbon fibers | XN-100-05M Addition amount (Parts) | 40 | 40 | 40 | 40 | 40 | 40 |
| | PAN-based foaming body | F-30 Expansion ratio of foaming | 1.5 | 2 | 3 | 1.3 | 3.2 | 4 |
| Evaluation | Heat conductivity | W/mK | 0.53 | 0.68 | 0.74 | 0.48 | 0.76 | 0.85 |
| | Pass through evaluation (1) | Durability | 3 | 3 | 3 | 3 | 2 | 2 |
| | Pass through evaluation (2) | Gloss unevenness | 3 | 3 | 3 | 2 | 3 | 3 |

TABLE 4

| | Material | Model | Ex. 13 | Ex. 2 | Ex. 14 | Ex. 15 | Ex. 16 | Ex. 17 |
|---|---|---|---|---|---|---|---|---|
| Blending ratio | Low molecular weight PTFE | KTL-8F Addition amount (Parts) | 100 | 100 | 100 | 100 | 100 | 100 |
| | Carbon fibers | XN-100-05M Addition amount (Parts) | 30 | 40 | 50 | 20 | 70 | 90 |
| | PAN-based foaming body | F-80ED Expansion ratio of foaming | 2 | 2 | 2 | 2 | 2 | 2 |
| Evaluation | Heat conductivity | W/mK | 0.5 | 0.66 | 0.78 | 0.38 | 0.92 | 1.2 |
| | Pass through evaluation (1) | Durability | 3 | 3 | 3 | 3 | 3 | 3 |
| | Pass through evaluation (2) | Gloss unevenness | 3 | 3 | 3 | 2 | 3 | 3 |

Examples 18 to 23

Examples 18 to 23 are formed with the same blending ratio as the highly heat conductive pressing members of Examples 1 to 6. Method of molding is extrusion molding Die temperature is controlled to 280±10° C. and a sheet of the highly heat conductive pressing members having 2 mm thickness is extruded. The sheet of the highly heat conductive pressing members having 2 mm thickness is cut to 320 mm length and 10 mm width. Thus, pressing members of Examples 18 to 23 are prepared. Evaluation of Example 1 is repeated for Examples 18 to 23. Refer to FIG. 5 for a schematic view.

Evaluation results are shown in Table 5.

TABLE 5

| | Material | Model | Ex. 18 | Ex. 19 | Ex. 20 | Ex. 21 | Ex. 22 | Ex. 23 |
|---|---|---|---|---|---|---|---|---|
| Blending ratio | Low molecular weight PTFE | KTL-8F Addition amount (Parts) | 100 | 100 | 100 | 100 | 100 | 100 |
| | Carbon fibers | XN-100-05M Addition amount (Parts) | 40 | 40 | 40 | 40 | 40 | 40 |
| | PAN-based foaming body | F-80ED Expansion ratio of foaming | 1.5 | 2 | 3 | 1.3 | 3.2 | 4 |
| Evaluation | Heat conductivity | W/mK | 0.55 | 0.66 | 0.73 | 0.49 | 0.8 | 0.89 |
| | Pass through evaluation (1) | Durability | 3 | 3 | 3 | 3 | 2 | 2 |
| | Pass through evaluation (2) | Gloss unevenness | 3 | 3 | 3 | 2 | 3 | 3 |

Comparative Example 1

Blending materials of the highly heat conductive pressing members in Example 1 are replaced with only the heat resistant resin as shown in Table 6 and Comparative Example 1 is formed. Thus, a pressing member of Comparative Example 1 is prepared. Evaluation of Example 1 is repeated for Comparative Example 1. Evaluation results are shown in Table 6.

Comparative Example 2

Blending materials of the highly heat conductive pressing members in Example 1 are replaced with only the heat resistant resin and the carbon fibers as shown in Table 6 and Comparative Example 2 is formed. Thus, a pressing member of Comparative Example 2 is prepared. Evaluation of Example 1 is repeated for Comparative Example 2. Evaluation results are shown in Table 6.

Comparative Example 3

Blending ratio of the highly heat conductive pressing members in Example 1 is replaced with the blending ratio shown in Table 6 and Comparative Example 3 is formed with only the heat resistant resin and PAN-based foaming body. Thus, a pressing member of Comparative Example 3 is prepared. Evaluation of Example 1 is repeated for Comparative Example 3. Evaluation results are shown in Table 6.

TABLE 6

| | Material | Model | Comp. Ex. 1 | Comp. Ex. 2 | Comp. Ex. 3 |
|---|---|---|---|---|---|
| Blending ratio | Low molecular weight PTFE | KTL-8F Addition amount (Parts) | 100 | 100 | 100 |
| | Carbon fibers | XN-100-05M Addition amount (Parts) | 0 | 40 | 0 |
| | PAN-based foaming body | F-80ED Expansion ratio of foaming | 0 | 0 | 2 |

TABLE 6-continued

| | Material | Model | Comp. Ex. 1 | Comp. Ex. 2 | Comp. Ex. 3 |
|---|---|---|---|---|---|
| Evaluation | Heat conductivity | W/mK | 0.2 | 0.29 | 0.15 |
| | Pass through evaluation (1) | Durability | 1 | 2 | 1 |
| | Pass through evaluation (2) | Gloss unevenness | 1 | 1 | 1 |

The following may be understood from the above-described Examples.

In Examples 1 to 6, expansion ratio of foaming is changed and evaluated.

The results show that in Example 4, the heat conductivity is approximately 0.5 W/mK or less and gloss unevenness due to temperature rise at end portions of the pressing member is seen though image evaluation is at a passing level. In Example 5 and 6, the expansion ratio of foaming is 3.2 or more. Breaking and loss of portions of the pressing members are seen in both Examples 5 and 6 though both are at a passing level. By contrast, Examples 1, 2, and 3 show no gloss unevenness in accordance with temperature rise at end portions of the pressing members, no breaking and loss of portions of the pressing members, and have obtained the highest passing level. Advantageous effects of the configuration of Examples 1, 2, and 3 are confirmed.

In Examples 7 to 12, the type of foaming body is changed and evaluation of Example 1 is repeated for Examples 7 to 12.

The results show that in Example 10, the heat conductivity is approximately 0.5 W/mK or less and gloss unevenness due to temperature rise at end portions of the pressing member is seen though image evaluation is at a passing level. In Examples 11 and 12, the expansion ratio of foaming is 3.2 or more. Breaking and loss of portions of the pressing members are seen in both Examples 11 and 12 though both are at a passing level. By contrast, Examples 7, 8, and 9 show no gloss unevenness in accordance with temperature rise at end portions of the pressing members, no breaking and loss of portions of the pressing members, and have obtained the highest passing level. Advantageous effects of the configuration of Examples 7, 8, and 9 are confirmed.

In Examples 13 to 17, content amount of carbon fibers changed and evaluation of Example 2 is repeated for Examples 13 to 17.

The results show that in Example 15, the heat conductivity is approximately 0.5 W/mK or less and gloss unevenness due to temperature rise at end portions of the pressing member is seen though image evaluation is at a passing level. By contrast, Examples 13, 14, 16, and 17 that have content amount of carbon fibers of 30 parts by weight or more show no gloss unevenness in accordance with temperature rise at end portions of the pressing members, no breaking and loss of portions of the pressing members, and have obtained the highest passing level. Advantageous effects of the configuration of Examples 13, 14, 16, and 17 are confirmed.

In Examples 18 to 23, the whole pressing member in the axial direction is formed of only the highly heat conductive pressing members that have the blend according to an embodiment of the present invention. Evaluation of Example 1 is repeated for Examples 18 to 23.

The results show that in Example 21, the heat conductivity is approximately 0.5 W/mK or less and gloss unevenness due to temperature rise at end portions of the pressing member is seen though image evaluation is at a passing level. In Examples 22 and 23, the expansion ratio of foaming is 3.2 or more. Breaking and loss of portions of the pressing members are seen in both Examples 22 and 23 though both are at a passing level. By contrast, Examples 18, 19, and 20 show lower effect than Examples 1, 2, and 3 but show no gloss unevenness in accordance with temperature rise at end portions of the pressing members, no breaking and loss of portions of the pressing members, and have obtained the highest passing level. Advantageous effects of the configuration of Examples 18, 19, and 20 are confirmed.

In Comparative Example 1, the whole pressing member in the axial direction is formed of only the heat resistant resin instead of the highly heat conductive pressing members and evaluation of Example 1 is repeated for Comparative Example 1. The results show that in Comparative Example 1, the heat conductivity is approximately 0.2 W/mK and is below approximately 0.5 W/mK. Gloss unevenness due to temperature rise at end portions of the pressing member is seen at a No Good (hereinafter referred to as NG) level. Breaking and loss of portions of the pressing member is seen at a NG level.

In Comparative Example 2, the whole pressing member in the axial direction is formed of only the heat resistant resin and carbon fibers instead of the highly heat conductive pressing members and evaluation of Example 1 is repeated for Comparative Example 2. The results show that in Comparative Example 2, the heat conductivity is approximately 0.29 W/mK and is below approximately 0.5 W/mK. Gloss unevenness due to temperature rise at end portions of the pressing member is seen at a NG level. Breaking and loss of portions of the pressing member is seen through is at an OK level.

In Comparative Example 3, the whole pressing member in the axial direction is formed of only the heat resistant resin having foamed hole portions instead of the highly heat conductive pressing members and evaluation of Example 1 is repeated for Comparative Example 3. The results show that in Comparative Example 3, the heat conductivity is approximately 0.15 W/mK and is below approximately 0.5 W/mK. Gloss unevenness due to temperature rise at end portions of the pressing member is seen at a NG level. Breaking and loss of portions of the pressing member is seen at a NG level.

From the above-described examples, employing the pressing member according to an embodiment of the present invention obtains prevention of heat diffusion in a circumferential direction of a fixing sleeve, mitigation of abnormal temperature rise at end portions of the pressing member due to passing through the small size recording sheet continuously, and reduction of uneven gloss due to uneven heat while maintaining durability. Employing the pressing member according to an embodiment of the present invention in the fixing device obtains high quality image, reduction in stopping for a short time period due to abnormal temperature rise at end portions of the pressing member, and enhancement of durability and reliability. Employing the above-described fixing device in an electrophotographic image forming apparatus such as a copier, a facsimile machine, and a laser beam printer obtains high durability and high reliability contributing to "heightening customer satisfaction."

The pressing member according to an embodiment of the present invention has highly heat conductivity and low heat capacity. Accordingly, the pressing member has good heat diffusion. Employing the pressing member in the fixing device obtains mitigation of abnormal temperature rise at end portions of the pressing member due to passing through the small size recording sheet continuously, reduction of uneven gloss leading to high quality image, reduction in stopping for a short time period due to abnormal temperature rise at end portions of the pressing member, prevention of wrinkling of the small size recording sheet, and enhancement of durability and reliability of the pressure roller.

What is claimed is:

1. A pressing member provided in a fixing device including a fixing member, a heating member to heat the fixing member, and a pressure roller, the pressing member comprising:

a heat resistant material;

highly heat conductive needle shaped fillers included in the heat resistant material; and hole portions included in the heat resistant material, wherein the pressing member is arranged to press the fixing member and form a nip portion between the fixing member and the pressure roller through which a recording sheet passes, the heat resistant material, the highly heat conductive needle shaped fillers included in the heat resistant material, and the hole portions included in the heat resistant material are provided solely at first regions of the pressing member corresponding to end portions of a small size recording sheet, the first regions of the pressing member corresponding to the end portions of the small size recording sheet are bounded by second regions of the pressing member corresponding to end portions of a maximum size recording sheet, and the second regions of the pressing member corresponding to the end portions of the maximum size recording sheet are configured only of the heat resistant material.

2. The pressing member of claim 1, wherein the highly heat conductive needle shaped fillers are oriented in an axial direction of the fixing member.

3. The pressing member of claim 1, wherein the highly heat conductive needle shaped fillers are pitch-based carbon fibers.

4. The pressing member of claim 1, wherein the heat resistant material is fluorine-based polymer.

5. The pressing member of claim 4, wherein the fluorine-based polymer is polytetrafluoroethylene.

6. The pressing member of claim 1, wherein portions of the pressing member including the heat resistant material, the highly heat conductive needle shaped fillers included in the heat resistant material, and the hole portions included in the heat resistant material have a heat conductivity of approximately 0.5 W/mK or more in an axial direction of the fixing member.

7. The pressing member of claim 1, wherein portions of the pressing member including the heat resistant material, the highly heat conductive needle shaped fillers included in the heat resistant material, and the hole portions included in the heat resistant material have an expansion ratio of foaming in a range from approximately 1.5 or more to approximately 3.0 or less.

8. A fixing device employed in a process of heating a toner image on a recording sheet and fixing the toner image onto the recording sheet, the fixing device comprising:

a fixing member;

a heating member to heat the fixing member;

a pressure roller; and a pressing member arranged to press the fixing member and form a nip portion between the fixing member and the pressure roller through which a recording sheet passes, the pressing member including a heat resistant material, highly heat conductive needle shaped fillers included in the heat resistant material, and hole portions included in the heat resistant material, wherein the heat resistant material, the highly heat conductive needle shaped fillers included in the heat resistant material, and the hole portions included in the heat resistant material are provided solely at first regions of the pressing member corresponding to end portions of a small size recording sheet, and the first regions of the pressing member corresponding to the end portions of the small size recording sheet are bounded by second regions of the pressing member corresponding to end portions of a maximum size recording sheet, wherein the second regions of the pressing member corresponding to the end portions of the maximum size recording sheet are configured only of the heat resistant material.

9. An image forming apparatus comprising the fixing device of claim 8.

* * * * *